US005361714A

United States Patent [19]

Hartwig

[11] Patent Number: 5,361,714

[45] Date of Patent: Nov. 8, 1994

[54] SEWING MACHINE WITH ELECTRONIC CONTROL DEVICE

[75] Inventor: Jürgen Hartwig, Pforzheim, Germany

[73] Assignee: Pfaff Haushaltmaschinen GmbH, Karlsruhe, Germany

[21] Appl. No.: 838,214

[22] PCT Filed: Sep. 7, 1990

[86] PCT No.: PCT/EP90/01506

§ 371 Date: Sep. 14, 1993

§ 102(e) Date: Sep. 14, 1993

[87] PCT Pub. No.: WO91/03587

PCT Pub. Date: Mar. 21, 1991

[30] Foreign Application Priority Data

Sep. 8, 1989 [DE] Germany ..... 3929948

[51] Int. Cl.[5] ..... D05B 3/02

[52] U.S. Cl. ..... 112/445; 112/458

[58] Field of Search ..... 112/445, 458, 453, 454, 112/456, 457, 121.11, 121.12

[56] References Cited

U.S. PATENT DOCUMENTS 4,499,836 2/1985 Meier .
4,577,574 3/1986 Takahashi ..... 112/445
4,622,907 11/1986 Kimura ..... 112/454 X
4,648,341 3/1987 Kato et al. ..... 112/458
4,860,678 8/1989 Skogward ..... 112/458 X
5,097,779 3/1992 Ishikawa et al. ..... 112/445

*Primary Examiner*—Peter Nerbun
*Attorney, Agent, or Firm*—McGlew and Tuttle

[57] ABSTRACT

A sewing machine with a display for displaying basic patterns to be sewn and parameters associated with these patterns. The display is switchable between formats representing different sets of basic patterns and is switchable to a plurality of sequential formats, where each of the sequential formats only displays necessary sequential information for one of the basic patterns and parameters. The display includes a symbol adjacent each of the basic patterns and parameters and the same set of symbols is displayed in each display format. A key board includes a plurality of individual keys which correspond to the symbols on the display. A microprocessor reads the key board to determine which keys have been activated and then changes the display to show the next sequential format when the key corresponding to the symbol adjacent one of the basic patterns and parameters is activated. The microprocessor also modifies the parameters of the pattern and activates a control program if the symbol associated with the key is adjacent a parameter on a control program.

6 Claims, 4 Drawing Sheets

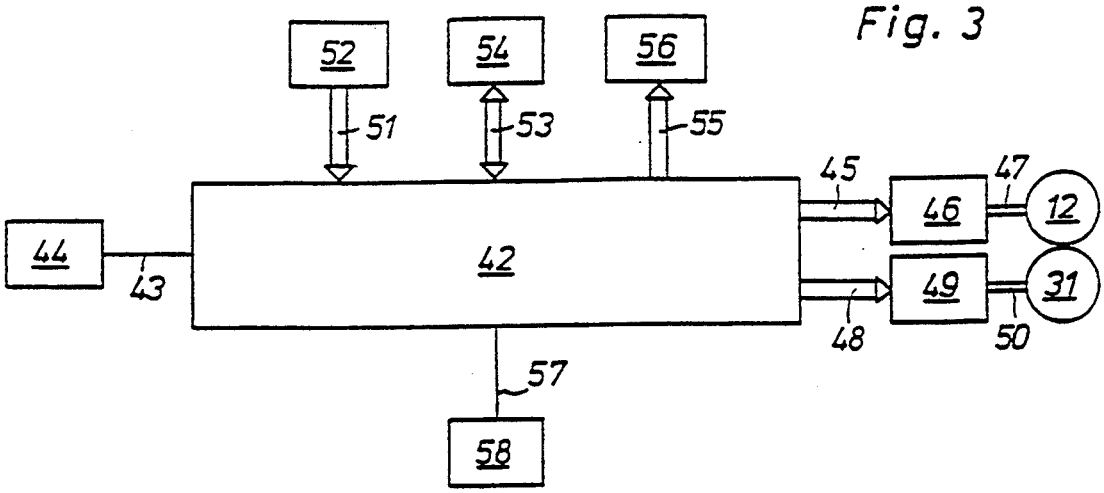
Fig. 3
Fig. 7
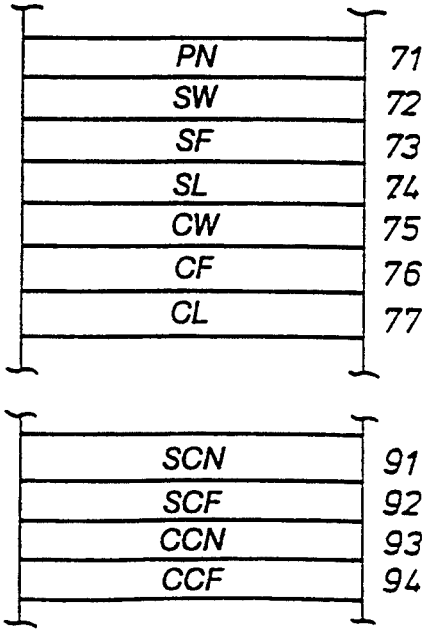

SEWING MACHINE WITH ELECTRONIC CONTROL DEVICE

FIELD OF INVENTION

The present invention pertains to a sewing machine which has a display unit for displaying the different patterns to be sewed and a keyboard for selecting the patterns. In particular the present invention also displays the parameters for a particular pattern after that particular pattern has been selected.

BACKGROUND OF THE INVENTION

In a prior-art sewing machine (U.S. Pat. No. 4,499,836), a plurality of differently preprogrammed sewing patterns can be prepared. These sewing patterns are selected from a table, in which the sewing patterns are represented together with a corresponding code number, which latter is entered via a keyboard to select the pattern. This alone requires a fairly great effort for finding the sewing pattern. To determine the different sewing parameters of the sewing pattern selected, it is necessary to subsequently enter the sewing parameter values via additional keys associated with the individual parameter displays. This is very confusing for the operator, and usually requires repeated looking in the operating manual of the sewing machine.

A sewing machine having an electronic display unit has become known from U.S. Pat. No. A-4,860,678. The display unit of this sewing machine shows, at the same time, an excessively large number of display fores, from which the operator can make a selection by means of a key-controlled cursor. The simultaneous presentation of such a large number of possible selections is confusing for the operator and therefore makes it difficult to operate the sewing machine.

U.S. Pat. No. A-4,622,907 discloses a sewing machine with which a plurality of letters and letter combinations can be prepared. A separate key of a keypad is associated with each letter that can be prepared, and this key shows a sewing pattern symbol corresponding to the associated letter. Even though such a device may be suitable for selecting patterns that are intended to represent letters, selecting individual sewing patterns or groups of sewing patterns of similar shape or their setting parameters would require a confusingly and great operating effort.

SUMMARY AND OBJECTS OF THE INVENTION

To eliminate these disadvantages, the basic task of the present invention is to provide a selection and display device for pattern selection in an electronic sewing machine with which both the pattern selection and the parameter setting of the selected sewing pattern can be performed consecutively without problems.

The solution according to the present invention, leads to a pattern selection and display device which is easy to operate and has a compact design despite the substantially enlarged sewing pattern and parameter display.

BRIEF DESCRIPTION OF THE DRAWINGS

FIGS. 1 through 7 show one embodiment of the present invention:

FIG. 1 shows the front view of a sewing machine with the arm cover folded out, FIG. 2 shows the drive of the stitch position and feed control unit of the sewing machine, FIG. 3 shows a block diagram of the control system of the sewing machine, FIGS. 4–6 show different display forms of the display unit installed in the am cover of the sewing machine, and FIG. 7 shows a representation for explanation of the contents of the working memory.

DETAILED DESCRIPTION OF THE PREFERRED EMBODIMENTS

Figure 1:
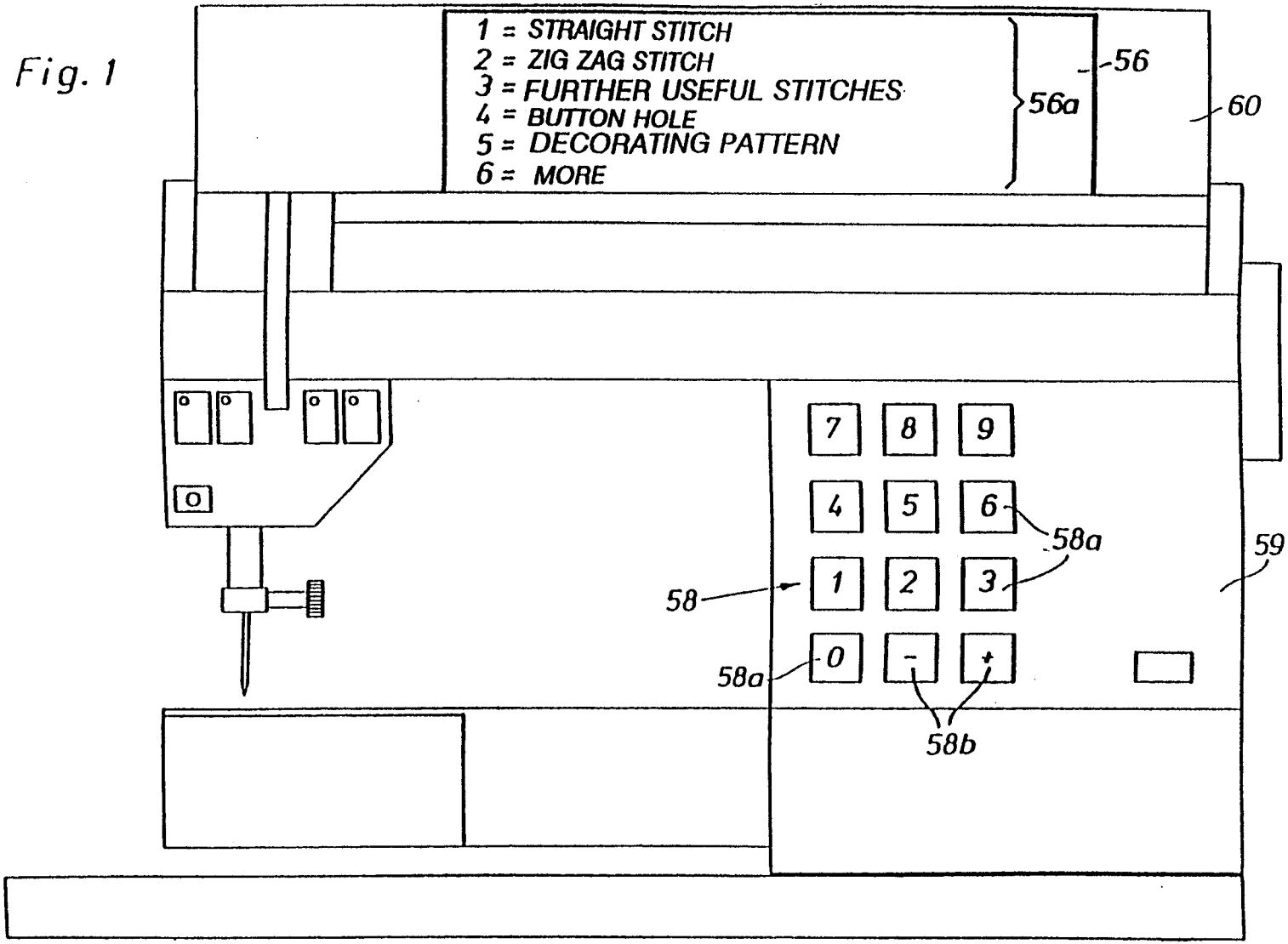
Figure 2:
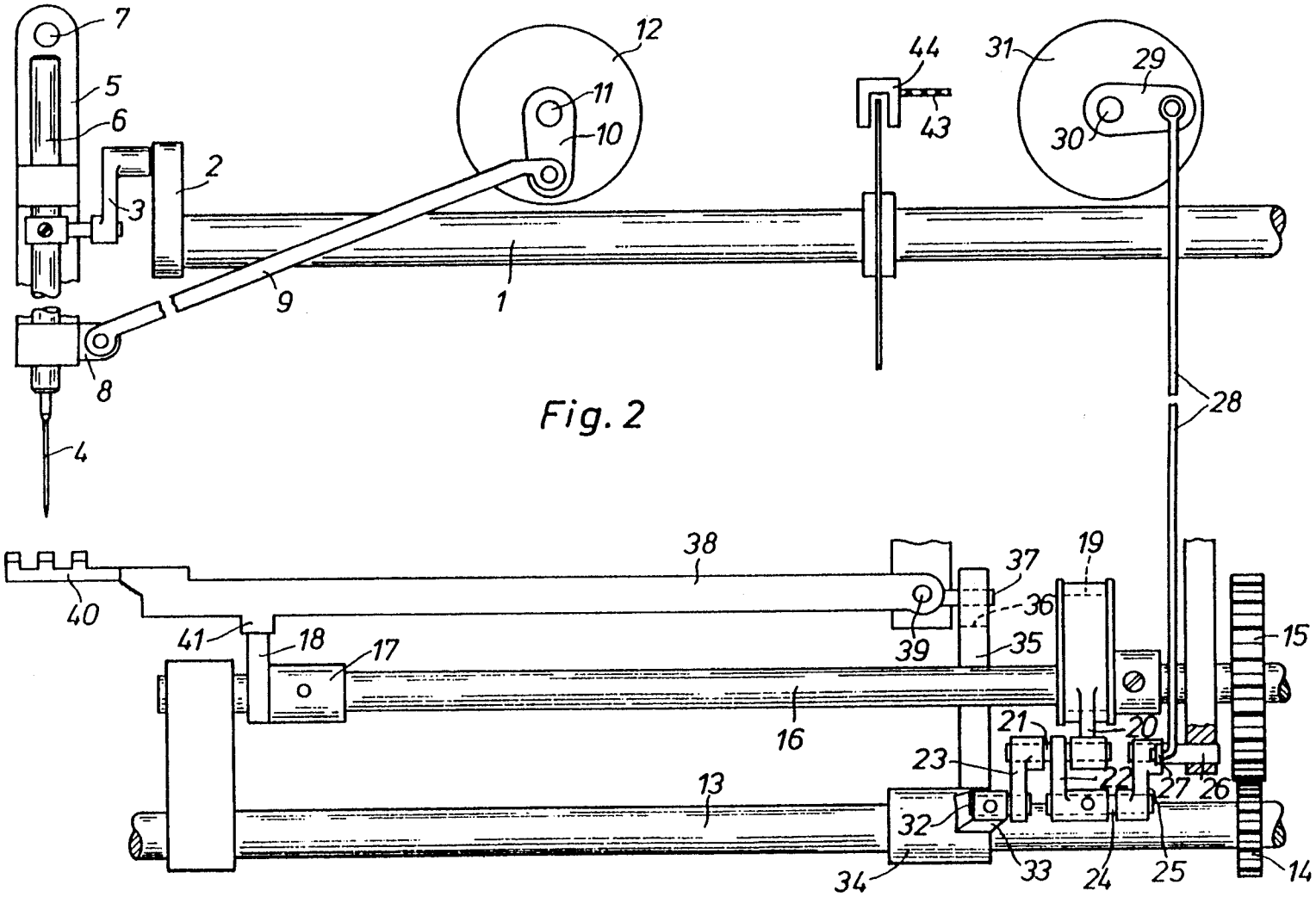
Figure 4:
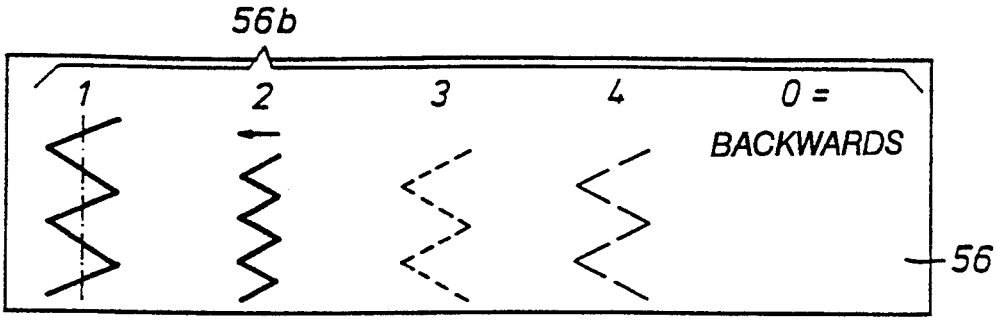

As is shown in FIG. 2, the sewing machine is equipped with a main shaft 1, which causes a needle bar 6, which is provided with a needle 4 and is mounted in a rocker guide 5, to perform vertical lifting movements via a crank 2 and a connecting rod 3. The guide rocker 5 is mounted in the housing of the sewing machine shown in FIG. 1 by means of a pin 7.

The guide rocker 5 has a projection 8, which is connected via a connecting rod 9 to a crank 10, which is fastened to a shaft 11 of a stepping motor 12 arranged in the housing of the sewing machine to control the stitch positions of the needle 4.

Via a chain (not shown), the main shaft 1 drives a lower shaft 13. A gear 14, which engages a gear 15 that is fastened to a shaft 16 mounted in parallel to the shaft 13, is fastened to the shaft 13. A lifting cam 17, which carries a lobe 18, is screwed firmly onto this shaft 16. Furthermore, a cam 19, which is surrounded by a cam rod 20, to which two connecting rods 22 and 23 are hinged by means of a bolt 21, is fastened to the shaft 16. The connecting rod 22 is rotatably connected via a bolt 24 to an angle lever 25, which is rotatably mounted on a shaft 26 fastened in the housing of the sewing machine and is connected—via an am 27 of the angle lever 25 and a bar 28—to a crank 29, which is fastened to the shaft 30 of a second stepping motor 31, which is arranged in the housing of the sewing machine and controls the feed of the sewing machine.

The connecting rod 23 is hinged by a bolt 32 to one arm 33 of a rocking lever 34 mounted on the shaft 13. A second, upwardly extending arm 35 of the rocking lever 34 has, at its end, a guide slot 36, in which is pin 37 is guided. This pin is fastened to a supporting arm 38, which is displaceably mounted on a horizontal shaft 39 fastened in the housing of the sewing machine in parallel to the feed mechanism. At its free end, the supporting arm 38 carries a feed dog 40, which is provided to transport the fabric to be sewn by the needle 4 in cooperation with a shuttle (not shown). The supporting arm 38 is supported on the lobe 18 of the lifting cam 17 via a downwardly directed web 41.

The designs and the principles of control of the two stepping motors 12 and 31 are identical. The stepping motor 12 is used to control the lateral oscillating movement of the guide rocker 5, while the stepping motor 31 is intended to control the displacing movement of the feed dog 40.

A microprocessor, as shown in FIG. 3, whose central processor 42 is connected via lines 43 to a pulse generator 44 driven synchronously by the main shaft 1 of the sewing machine, is provided in the housing of the sewing machine. On each revolution of the machine, the pulse generator sends one impulse to the central processor 42 when the needle 4 has left the fabric being sewn, and the stepping motor 12 is able to adjust the needle bar position; in addition it does so also when the feed dog 40 has completed its feed movement and the stepping motor 31 is able to perform the control of a new amount of feed. A stitch position control unit 46, which is connected to the stepping motor 12 via lines 47, is connected to the central processor 42 via lines 45. Via lines 48, the central processor 42 is connected to a feed control unit 49, and the latter is connected to the stepping motor 31 via lines 50.

A read-only memory (ROM) 52 is connected to the central processor 42 via lines 51, a working memory (RAM) 54 is connected via lines 53, and a display unit 56 is connected via lines 55. In addition, a keyboard 58 is connected to the central processor 42 via lines 57. The keyboard 58 is arranged on the front side 59 of the housing, as shown in FIG. 1 of the sewing machine and has keys 58*a*, whose top sides are marked with a symbol (0. . . 9) each. The keyboard 58 also has two separate keys 58*b*, whose top sides are marked with a special symbol (+or−).

The display unit 56 consists of an LCD display module, on which various display forms 56*a*, 56*b*, 56*c*, see FIGS. 1 and 4 through 6 can be represented, and in which both graphic symbols and characters may be contained. It is arranged inside a cover 60 arranged pivotably on the housing of the sewing machine.

A plurality of basic sewing patterns in binary form are stored in the read-only memory. The individual basic pattern may consist of a sequence, of any length, of individual stitches, but also of a single individual stitch or a very small number of individual stitches. A pattern number and several specific data values for this sewing pattern, e.g., standard width, standard stitch length, standard pattern length, maximum length, etc., are stored at the beginning of each sewing pattern stored. These are followed by the stitch position and feed coordinates predetermined for preparing the sewing pattern.

The sewing pattern is selected and the stitch width, the stitch position, and the stitch length are set via the keys 58*a* of the keyboard 58. The display unit 56 is driven by the microprocessor 42 such that the operator is led, by means of the display in the display unit 56, to the desired sewing pattern and to the selection of the necessary or desired sewing parameters of the sewing pattern selected. On actuating one of the keys 58*a* or 58*b*, the microprocessor 42 controls at the same time, besides the corresponding switching over of the display unit 56 to another display form 56*a*, also the function for influencing a control process, which function is associated with the key 58*a* being actuated; this [control process] may consist of the selection of a basic pattern or the adjustment of a control means for the stitch position or the feed.

The ROM 52 contains various tables, in which the mode of representation of various menus that can be displayed in the display unit 56, the ranges of adjustment of the sewing parameters (width, stitch length or pattern length), as well as the mode of representation of the patterns in the display unit 56 are stored. When a basic pattern is selected or sewing parameters are set, the microprocessor 42 locates the start address of the table belonging to the pattern, takes the corresponding display data from it, and displays them in the corresponding display form 56*a*, 56*b*, 56*c* in the display unit 56.

Immediately after the selection of a basic pattern by a key 58*a*, the basic data corresponding to the sewing pattern selected are taken over by the microprocessor 42 from the read-only memory 52 into the working memory 54 to prepare the sewing patterns by the sewing machine. The basic data of the sewing pattern are now stored in consecutive memory cells, as shown in FIG. 7. The pattern number PN is located in the first memory cell 71, the standard width SW associated with the sewing pattern in the next memory cell 72, the standard feed SF associated with the sewing pattern in the memory cell 73, the standard pattern length SPL associated with the sewing pattern in the memory cell 74, the current width CW in the memory cell 75, the current feed CF in the memory cell 76, and the current pattern length CL in the memory cell 77. When the basic data are taken over from the read-only memory 52 into the working memory 54, the standard values taken over into the memory cells 72, 73 and 74 are also stored in the corresponding memory cells 75, 76, and 77. The contents of the memory cells 75, 76 and 77 are polled by the central processor 42 via the lines 53, converted, and then transformed, in a manner dependent on the sewing pattern, into a display code, which will be displayed in the display unit 56. They can be altered by actuating the keys 58. The altered value will then also appear in the display unit 56. At the same time, the altered value is also stored, coded correspondingly, by the central processor 42 in the memory cells 75, 76 and 77.

During sewing, the consecutive standard coordinate values for the needle position SCN and for the feed SCF for each subsequent stitch, which are associated with the sewing pattern in the read-only memory 52, are controlled by the pulse generator 44, read by the central processor 42 from the read-only memory 52, and taken over into the memory cells 91 and 92 of the working memory 54. The microprocessor computes the new coordinate value that is to be actually performed from the current standard coordinate value, the standard value, and the current value, and stores it via the microprocessor 42 in the corresponding memory cell 91 or 92. Subsequently the number of steps to be performed and the direction of rotation of the corresponding stepping motor 12 or 31 from the current coordinate value CCN and CCF, respectively, of the preceding step is computed, which is stored in the memory cells 93 and 94, respectively, and from the coordinate value of the new stitch SCN and SCF, respectively, from the cells 91 and 92, respectively, and controls the stepping motor 12 via the stitch position control unit 46 and the stepping motor 31 via the feed control unit 49.

The stepping motor 12 turns the guide rocker 5 into the new stitch position for the needle via the crank 10 and the connecting rod 9. Via the crank 29, the bar 28, and the angle lever 25, the stepping motor 31 adjusts the bolt 24, so that its longitudinal axis will no longer be aligned with the longitudinal axis of the bolt 32. Thus, a pivoting movement around the shaft 13 is imparted to the rocking lever during the rotation of the cam 19, and this [pivoting movement] is transmitted as a pushing movement to the feed dog 40 transporting the fabric being sewn via the arm 35 around the supporting arm 38. The feed dog 40 receives its usual lifting movement via the lobe 18 of the lifting cam 17, which said cam cooperates with the web 41 of the supporting am 38.

When the sewing machine is turned on, a main menu is displayed by the control unit of the microprocessor 42 on the display unit 56, as is shown in FIG. 1.

Controlled by the microprocessor 42, the keys 58*a* with the symbols 1 through 6 are activated, while the other keys 58*a* are blocked. The microprocessor 42 turns on a simple straight stitch seam with a stitch length of 2.5 min. This corresponds to the actuation of the key 58*a* bearing the symbol "1."

If the starter of the sewing machine is now actuated without the operator having actuated a key 58*a*, this straight stitch described will be prepared by the sewing machine.

The operator normally selects a basic pattern by actuating one of the keys 58*a* prior to starting up the machine. This is done first from the main menu, as in FIG. 1, displayed in the display unit 56, in the display fore 56*a*. This displays the most essential groups of basic patterns by name. Next to the name, a symbol (1 . . . 6) is always represented, each of which is identical to a symbol (1 . . . 6) on one of the respective keys 58*a*. If further groups of basic patterns are to be displayed, the display unit 56 can be switched over to these other groups of basic patterns by actuating the key 58*a* bearing the symbol "6."

When one of the activated keys 58a is actuated, the microprocessor 42 switches the display unit 56 to another display form with special selection criteria for the selection just made. If, for example, the key 58*a* bearing the symbol "2" is actuated, the microprocessor 42 switches over the display unit 56, which will now display the zigzag menu (said display form 56*b*) shown in FIG. 4. Various zigzag patterns that can be prepared are shown in the display form 56*b*, and one of these zigzag patterns can be selected by actuating the key 58*a*, whose symbol is identical to the symbol of the corresponding pattern.

Figure 5:
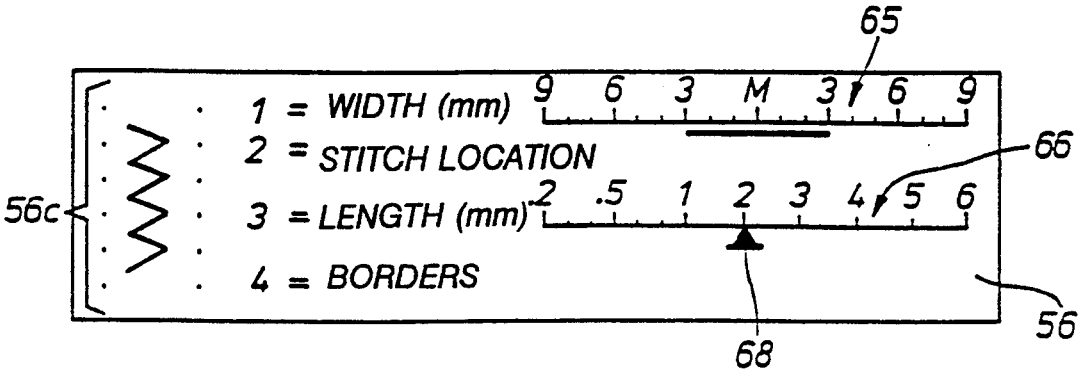

If, for example, the key bearing the symbol "3" is now actuated, the display form 56*c* shown in FIG. 5 will appear in the display unit 56, and the sewing pattern is displayed to the left on a larger scale. The key numbers that can be selected, as well as their parameter meanings (width, length, etc.) are also displaced.

Next to the name "width" and the name "length," one scale 65, 66 each is also displayed; these display the possible overstitch length and the possible stitch length, respectively, in an enlarged form. Below the scale 65 a transverse bar 67 appears, whose displayed length indicates the currently set stitch width and whose position below the scale 65 indicates the currently set stitch position of the overstitch within the possible stitch field. Below the scale 66, a cursor 68 appears, whose position indicates the currently set stitch length. The corresponding parameter values of the length and position of the transverse bar 67 and of the position of the cursor 68 are taken from a parameter table associated with the respective pattern in the ROM 52. When switching over to the parameter display as shown in, e.g., FIG. 5, the microprocessor 42 locates the standard width, the standard position, and the standard length, which correspond to the pattern. The possible changes in width and length are stored step by step in the parameter table, so that when one of the keys 58*a* is actuated, the microprocessor 42 will read the next or preceding parameter value and display it in the display unit 56 in an appropriate manner.

For example, the transverse bar 67 in FIG. 5 indicates a set stitch width of 3 mm in the middle position M of the stitch field. By actuating the key 58*b* bearing the symbol "+" or "−," the length of the bar and consequently the stitch width can be increased or decreased.

Figure 6:
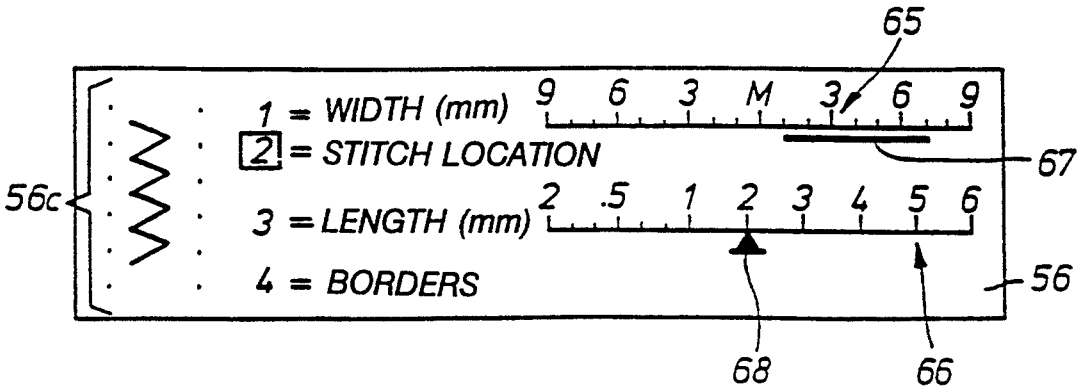

To change the stitch position, the key 58*a* beating the symbol "2" is actuated, after which the number 2 will be displayed as a numeral in reverse video and the number "1" will be displayed normally. When the key 58*b* bearing the symbol "+" or "−" is actuated, the position of the set stitch width can be shifted within the intended stitch field, e.g., to the right, as is shown in FIG. 6.

The stitch length is set by actuating the key 58*a* bearing the symbol "3," which will be displayed in reverse video. When the key 58*b* bearing the symbol "+" or "−" is actuated, the cursor 68 under the dial 66 will be shifted to the right or left. It will show the value of the stitch length newly set by the microprocessor 42.

The values to be set are displayed in reverse video and can be altered with the key 58*b* bearing the symbol "+" or "−." To do so, the key 58*a* associated with the corresponding parameter 1 . . . 3 must first be actuated, as a result of which the corresponding number 1 . . . 3 will also be displayed in reverse video in the display unit 56. Thus, based on the main menu, as is shown in FIG. 1 in the display form 56*a* of the display unit 56, the operator will be consecutively led, e.g., via the representation of the display form 56*b* in FIG. 4, to the setting of the desired sewing pattern and to the setting of its parameters display form 56*c* in FIG. 5), without having to find this sewing pattern and its parameters in a table and without consequently having to enter a code number corresponding to this pattern or the corresponding parameter values on various keyboards associated with the individual parameters.

I claim:

1. A sewing machine comprising:

fabric transport means for transporting a fabric through the sewing machine;

stitch forming means for forming stitches in the fabric as the fabric is moved through the sewing machine;

read-only memory means for storing a plurality of basic patterns and control programs which drive said fabric transport means and said stitch forming means;

read-write memory means for receiving said basic patterns and control programs from said read-only memory means;

display means for displaying indicia representing said basic patterns and parameters related to said basic patterns, said display means being switchable between formats representing different sets of said basic patterns and switchable to a plurality of sequential formats, each of said sequential formats only displaying necessary sequential information for one of said basic patterns and parameters, said display means displaying a symbol adjacent each of said indicia representing said basic patterns and parameters, a same set of said symbols being displayed in a plurality of said formats;

a keyboard including a plurality of individual keys, a set of said plurality of keys corresponding to said symbols;

microprocessor means for moving said basic patterns and control programs from read-only memory means to said read-write memory means and for modifying said basic patterns and control programs in said read-write memory means, said microprocessor means also reading said keyboard to determine which of said keys have been activated, said microprocessor changing said display means to a next of said sequential formats when a key corresponding to a symbol adjacent said one of said basic patterns and parameters is activated, said microprocessor means also modifying said parameters and activating a control program in said read-write memory means which is related to said symbol adjacent said one of said basic patterns and parameters when said key corresponding to said symbol adjacent said one of said basic patterns and parameters is activated.

2. A sewing machine in accordance with claim 1, wherein:

said microprocessor means only energizing said keys which correspond to said symbols currently being displayed.

3. A sewing machine in accordance with claim 1, wherein:

said display unit is a single dot matrix display.

4. A sewing machine in accordance with claim 1, wherein:

said indicia representing said basic patterns includes simulated sewing patterns related to said basic patterns.

5. A sewing machine in accordance with claim 1, wherein:

said indicia representing said parameters includes a scale and a cursor, said cursor being formed as a bar positioned adjacent and substantially parallel to said scale;

said keyboard includes another set of keys cooperating with said microprocessor to change a position of said cursor and a length of said cursor.

6. A sewing machine in accordance with claim 1, wherein:

said display means displays said symbol corresponding to said actuated key in reverse video.

* * * * *